US010932975B2

(12) United States Patent
Voirin et al.

(10) Patent No.: US 10,932,975 B2
(45) Date of Patent: Mar. 2, 2021

(54) COVERING DEVICE FOR AN INCUBATOR FOR NEWBORNS

(71) Applicant: CONSEILS, RECHERCHES ET DEVELOPPEMENTS EN SANTE (CO.R.DE.S), Nancy (FR)

(72) Inventors: Sylvie Voirin, Tomblaine (FR); Jean Michel Hascoet, Lay Saint Christophe (FR)

(73) Assignee: COnseils, Recherches et DEveloppements en Sante, Nancy (FR)

( * ) Notice: Subject to any disclaimer, the term of this patent is extended or adjusted under 35 U.S.C. 154(b) by 55 days.

(21) Appl. No.: 15/569,336

(22) PCT Filed: Apr. 11, 2016

(86) PCT No.: PCT/FR2016/050827

§ 371 (c)(1),
(2) Date: Oct. 25, 2017

(87) PCT Pub. No.: WO2016/174325

PCT Pub. Date: Nov. 3, 2016

(65) Prior Publication Data

US 2018/0311100 A1 Nov. 1, 2018

(30) Foreign Application Priority Data

Apr. 28, 2015 (FR) ..... 15 53819

(51) Int. Cl.
*A61G 11/00* (2006.01)

(52) U.S. Cl.
CPC ..... *A61G 11/00* (2013.01)

(58) Field of Classification Search
CPC ..... A61G 11/00–009; A61G 10/00–04; A01K 41/00–065
See application file for complete search history.

(56) References Cited

U.S. PATENT DOCUMENTS

| | | | | |
|---|---|---|---|---|
| 4,079,728 | A | 3/1978 | Gatts | |
| 5,781,946 | A * | 7/1998 | McEntire | B60N 2/6054 2/69 |
| 7,254,849 | B1 * | 8/2007 | Fiebrich | A41B 13/06 2/69.5 |
| 2006/0079730 | A1 | 4/2006 | Getsla | |
| 2010/0071709 | A1 * | 3/2010 | Grissom | A41B 13/06 128/870 |
| 2010/0257653 | A1 * | 10/2010 | Pitts | A41B 13/06 2/69.5 |
| 2014/0033430 | A1 * | 2/2014 | Daugherty | A41B 13/06 5/494 |

FOREIGN PATENT DOCUMENTS

TW M 455 489 U 6/2013

* cited by examiner

*Primary Examiner* — Thaddeus B Cox
(74) *Attorney, Agent, or Firm* — Craft Chu PLLC; Andrew W. Chu

(57) ABSTRACT

The covering device for an incubator for newborns includes a longitudinal direction characterized in that one of its ends, in the longitudinal direction, has a width at least two times greater than its width at its opposite end. At least in the median part of its larger width, it is extended by a longitudinal flap.

8 Claims, 2 Drawing Sheets

COVERING DEVICE FOR AN INCUBATOR FOR NEWBORNS

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to the field of hospital equipment for newborns. It more particularly relates to a covering device for incubators for newborns.

2. Description of Related Art Including Information Disclosed Under 37 CFR 1.97 and 37 CFR 1.98

Newborns, and more particularly premature newborns and sick newborns, require special care. They are generally kept under surveillance in incubators, in an environment where the temperature and other physical data, such as hygrometry, are precisely controlled.

The incubators are generally transparent, as a result of which the brightness is a more difficult physical parameter to control.

Depending on the care units, the brightness may be too high, or on the contrary, too low. Indeed, the incubators are either completely concealed by covering devices, or left as is under the light in the room.

This may result in disruptions to visual development through excessive light stimulation or disturbances in the establishment of the nychthemeral rhythm essential for the establishment of physiological hormone cycles through sufficient light stimulation.

Furthermore, completely concealing the incubator causes more frequent manipulations of the environment during access to the child for care, which may increase the risk of secondary infections.

Caregiver monitoring requirements and the need to keep spontaneous visual contact for parent-child relationships also come into play in controlling brightness.

Technical solutions are already known, but they only partially resolve the problems posed.

For example, utility certificate TWM 455489 proposes a complete covering device in which an opening possibility is arranged on top. This device makes it possible to establish and provide visual contact between the caregiving staff and the newborn when the top is open, but on the one hand, not enough light is able to penetrate the incubator, and on the other hand, a spontaneous relationship between the parents and the child cannot be established. Patent application US 2006 0079730 proposes a similar solution with identical drawbacks.

Premature newborns are very sensitive to their environment. The hospital environment, despite careful care from the staff, may cause a lack of the stimulation necessary for development. This may include a lack of visual stimulation.

Thus, specific adapted visual stimulation may help them develop their visual function.

BRIEF SUMMARY OF THE INVENTION

The present invention therefore aims to propose new means for resolving the drawbacks of the prior art. It more particularly aims to propose a covering device for an incubator for newborns including a longitudinal direction characterized in that one of its ends, in the longitudinal direction, has a width at least two times greater than its width at its opposite end; and in that at least in the median part of its larger width, it is extended by a longitudinal flap.

BRIEF DESCRIPTION OF THE SEVERAL VIEWS OF THE DRAWINGS

Other features and advantages of the present invention will appear upon reading the following detailed description, in reference to an example embodiment provided for information and non-limitingly.

This description will be easier to understand in reference to the appended drawings.

DETAILED DESCRIPTION OF THE INVENTION

Figure 1:
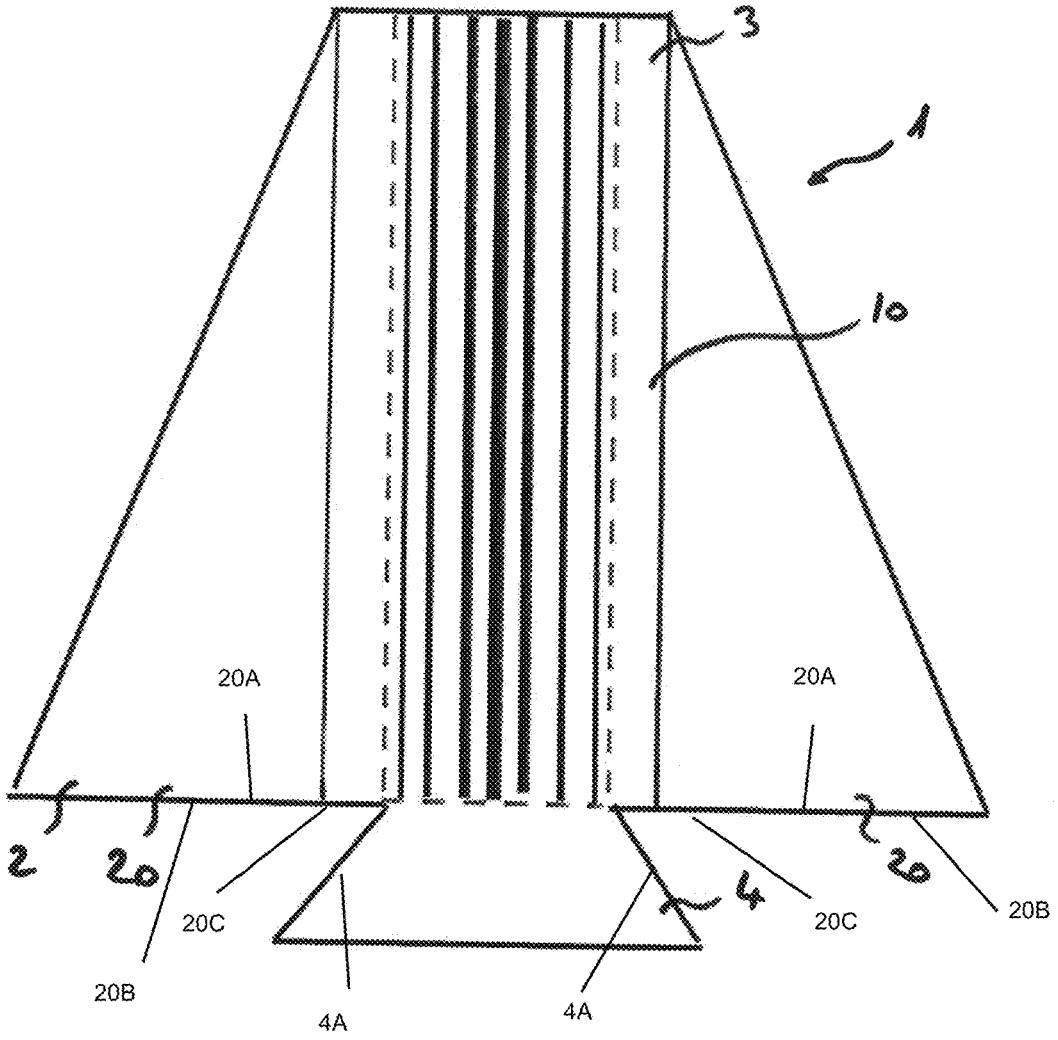
FIG. 1 is a schematic view, showing a covering device according to the invention.
Figure 2:
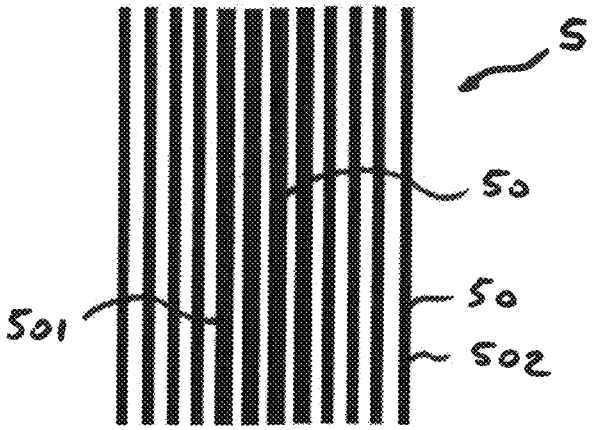
FIG. 2 is a schematic view, showing a target device according to the invention.
Figure 3:
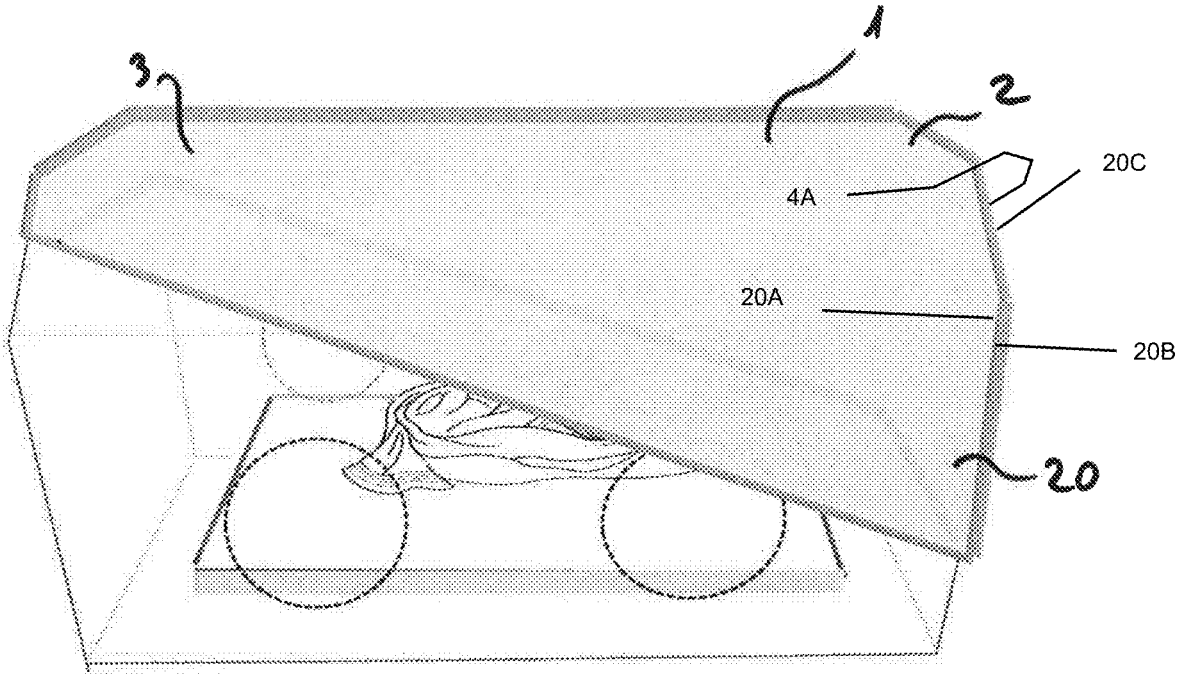
FIG. 3 is a schematic view, showing a view of the covering device arranged on an incubator.

Thus and as shown in FIGS. 1 to 3, the present invention first relates to a covering device 1 for an incubator for newborns including a rectangular median strip 10 with a longitudinal direction, characterized in that one of its ends (a flap end 2 and opposite end 3), in the longitudinal direction, has a width at least twice the size of its width at its opposite end 3; and in that at least in the median part of its larger width, it is extended by a longitudinal flap 4 with flap sides 4A.

The covering device 1 is generally arranged on top of an incubator with its widest end 2 arranged above the newborn's head in an installed configuration. The largest width of the covering device 1 forms side flaps 20 falling on the sides of the incubator, each side flap having a side flap edge 20A with a side flap cover portion 20B and a side flap lateral portion 20C.

In this way, the covering device 1 can form a slipcover when it is arranged on top of an incubator.

The flaps 4 and 20 with only each side flap end cover portion adjacent a corresponding flap side of the longitudinal flap in an installed configuration make it possible to protect the child from direct exposure to light while preventing him from being in total darkness. This access to indirect light facilitates the establishment of the nychthemeral rhythm, thus favoring the establishment of the endocrine cycles.

Furthermore, the child remaining accessible to outside view by the narrowest end or opposite end 3 of the cover 1, caregivers can monitor his behavior, in addition to automated monitoring.

The narrowest end 3 of the covering device 1 can easily be folded for access to the opening of the incubator.

The parents have direct visual access to their child with no intermediate obstacles.

The covering device 1, respecting access to the side care portholes, reduces inappropriate and excessive manipulations.

Advantageously, the covering device 1 is symmetrical relative to a longitudinal plane.

This symmetry allows easy positioning on top of the incubator.

Preferably, the covering device 1 includes a rectangular median strip 10, laterally extended at the widest end by side flaps 20 extended at least over one third of the length of the covering device 1.

The flaps 4 and 20 may have any shape. They can be attached to one another by conventional systems such as staples, self-adhesive strip-type fasteners, or can be sewn together.

According to one particular embodiment of the invention, the covering device 1 is in the form of a triangle with a truncated apex including a rectangular median strip 10 extended laterally by triangular side flaps 20.

The sense of vision is not fully developed the prenatal stage and is in a raw state at birth. In a hospital environment, premature newborns may lack visual stimulation. This deficiency can have long-term consequences on development.

This is why visual stimulation specially adapted to their maturation can help them develop their visual function more easily.

The invention thus also relates to a visual target device 5 adapted to newborns, characterized in that it includes a series of parallel longitudinal strips 50 in different colors.

Such a target device 5 can therefore be made independently of the covering device 1. It can for example be made on the cover of an incubator.

Advantageously, the covering device 1 serves as a support for a visual target device 5 for a newborn to look at.

The visual target device 5 comprises a particular pattern and can be associated with the part of the covering device 1 facing across from the newborn.

The advantage of such a target device 5 is its passive operation type. It allows visual stimulation of the newborn during his awake phases, which are intermittent.

Its regular presence on the covering device 1 allows regular, intermittent stimulation depending on the availability of the child, and not imposed, independently of any action by the caregiving staff.

Another advantage of its presence on the covering device is the ease of removing it when it is necessary to check the newborn through the cover or the upper part of the incubator or to place a care device, for example phototherapy.

Preferably, said target device 5 includes a series of longitudinal strips 50 in the longitudinal direction of said covering device 1, parallel and with different colors.

The different colors can be contrasting.

In general, the strips are designed as parallel lines having contrasting colors to attract newborns' attention.

According to another particular embodiment, said strips 50 have different widths.

According to still another embodiment, said strips 50 and 501 situated in the most median part of said target have a larger width than those 50 and 502 situated on the periphery.

Advantageously, said series of longitudinal strips 50 has a median axis of symmetry oriented along the length of said strips 50.

This particular organization has the advantage of increasing the newborn's interest in the device and fixing his attention more intensely, thus favoring the development of his visual discrimination.

According to one preferred embodiment, the covering device 1 includes means for concealing or filtering light, having a wavelength below 650 nm.

Wavelengths above 650 nm comprise the visual light, and above all the ultraviolets, which are particularly dangerous for the retina.

According to one advantageous embodiment, the covering device 1 as the slipcover includes means for filtering soundwaves.

The auditory system of newborns and premature babies is highly sensitive. Means for filtering soundwaves, such as a cellular structure situated in the thickness of the material or a lined and padded material, making up the device 1 allow attenuation of the surrounding noise.

We claim:

1. A covering device for an incubator for newborns, said covering device comprising:

a rectangular median strip having a longitudinal direction with a flap end and an opposite end opposite said flap end, said flap end having a width at least two times greater than a width of said opposite end;

a longitudinal flap at said flap end, said longitudinal flap having flap sides opposite each other; and a plurality of triangular side flaps, each triangular side flap having a side flap edge being comprised of a side flap end cover portion and a side flap lateral portion, wherein only each side flap end cover portion is adjacent a corresponding flap side of said longitudinal flap in an installed configuration so as to prevent direct exposure to light, allow indirect exposure to light, and allow access under said rectangular median strip.

2. The covering device, according to claim 1, said rectangular median strip and said plurality of triangular side flaps being symmetrical relative to said longitudinal direction of said rectangular median strip.

3. The covering device, according to claim 1, wherein each triangular side flap extends at least over one third of a longitudinal length of said rectangular median strip.

4. The covering device, according to claim 1, further comprising: a visual target device mounted on said rectangular median strip.

5. The covering device, according to claim 4, wherein said visual target device is comprised of a series of longitudinal strips extending in said longitudinal direction, each longitudinal strip being parallel to each other and having a respective color different from another longitudinal strip.

6. The covering device, according to claim 5, wherein at least one longitudinal strip has a respective width different from a width of an adjacent longitudinal strip.

7. The covering device, according to claim 6, wherein at least one longitudinal strip centered on said rectangular median strip has a respective width larger than a width of another longitudinal strip closer to a corresponding side flap.

8. The covering device, according to claim 1, further comprising: means for filtering soundwaves.

* * * * *